US005532483A

United States Patent [19]

Ose et al.

[11] Patent Number: 5,532,483

[45] Date of Patent: Jul. 2, 1996

[54] MASS SPECTROMETER AND ION SOURCE

[75] Inventors: Yoichi Ose, Mito; Kiyomi Yoshinari, Hitachi; Masayoshi Yano; Tadao Mimura, both of Hitachinaka, all of Japan

[73] Assignee: Hitachi, Ltd., Tokyo, Japan

[21] Appl. No.: 403,980

[22] Filed: Mar. 15, 1995

[30] Foreign Application Priority Data

Mar. 17, 1994 [JP] Japan ..... 6-047090

[51] Int. Cl.[6] ..... H01J 49/10

[52] U.S. Cl. ..... 250/288; 250/423 R

[58] Field of Search ..... 250/288, 288 A, 250/281, 423 R

[56] References Cited

U.S. PATENT DOCUMENTS 4,792,687 12/1988 Mobley ..... 250/423 R
5,420,437 5/1995 Siess ..... 250/423 R

FOREIGN PATENT DOCUMENTS 57-27553 2/1982 Japan .

*Primary Examiner*—Jack I. Berman
*Attorney, Agent, or Firm*—Kenyon & Kenyon

[57] ABSTRACT

An ion beam having a good converging property and a good quality is provided by satisfying the limitations controlling both angle of dispersion and the width of beam at the same time. The voltage 12*d* of a repeller electrode 1*f* in an ion source of electron bombardment type is input to an ion source state monitor 11 and the ion source state monitor 11 output a predicted value 12*e* of the voltage applied to an extractor electrode 1*g* to an extractor power source 9. As for the extractor electrode system, the width of a slit in the acceleration electrode 1*b* is made larger than the width of a slit of the extractor electrode 1*g*, and the extractor electrode 1*g* is set in a position apart from the acceleration electrode 1*b* by the distance nearly equal to the distance between the acceleration electrode 1*b* and the ion generating region 2*a*. By doing so, the electric field leaked from the slit of the acceleration electrode 1*b* to the inside of the ionization chamber 1*a* expands to the vicinity of the ion generating region. As the result, the ion beam 2 is effectively extracted to pass through the slits in the acceleration electrode 1*b* and the extractor 1*g*. The amount of the current passing through the slits is measured with an ion current monitor 8*a* and the voltage 12*f* of a converging electrode 1*d* is adjusted so that the value of the current becomes the maximum.

11 Claims, 6 Drawing Sheets

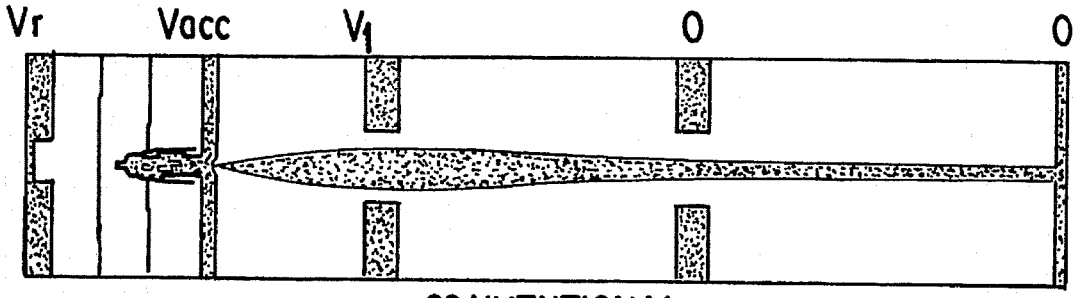
CONVENTIONAL
FIG.5A
PRESENT INVENTION

PLASMA FLOATING POTENTIAL OF 30V

PLASMA FLOATING POTENTIAL OF 60V, UNDER THE SAME VOLTAGE CONDITION AS IN FIG.6A

PLASMA FLOATING POTENTIAL OF 60V, UNDER CONTROLLING OPTIMIZED VOLTAGE CONDITION

MASS SPECTROMETER AND ION SOURCE

BACKGROUND OF THE INVENTION

The present invention relates to a mass spectrometer and, more particularly, to an ion source and a mass spectrometer having a beam extractor electrode system which is suitable for extracting a beam having a small angular dispersion and a high transmission characteristic from an ion source.

FIG. 7 is a cross-sectional view showing an ion source and a beam extractor electrode system in a conventional mass spectrometer. In a case of an ion source of electron bombardment ionization type, the ions generated by irradiation of electrons in an ionization chamber 1*a* are repelled with a repeller electrode if to which a positive voltage several volts higher than the voltage of the ionization chamber 1*a*. The ions are applied and pushed out through an extractor slit 15 of an acceleration electrode 1*b*. Since the ion beam 2 pushed out is dispersed after crossing at a cross-over point 2*c*, the ion beam 2 is converged by providing a focussing electrode 1*c* and accelerated between the acceleration electrode 1*b*. and a ground electrode 1*d* up to approximately 6 kV. During that period, in order to effectively guide the beam to an analyzing part, that is, a sector magnetic field and a sector electric field, the width and the dispersion angle of the beam 2 are controlled by adjusting the voltage of the focussing electrode 1*c*. Practically, at starting of operation of a mass spectrometer, the amount of ion current passing through a slit 1*e* is measured by inserting an ion current monitor 8*a* utilizing a Faraday cup, a multiplier and a channel plate into a region of the ion beam passing through. The voltage 12*f* applied to the converging electrode 1*c* is adjusted so that the current signal 12*a* becomes maximum. The prior art is described in Japanese Patent Application Laid-Open No. 57-27553 (1982).

In the above conventional technology, generally, the gap between the acceleration electrode 1*b* and the focussing electrode 1*c* is approximately 10 times as large as the width of the slit 15, and change in dispersion angle of the beam 2, that is, the positional change of the cross-over point 2*c*, against change in the electrode voltage is extremely small. However, the optical system of a mass spectrometer is required to keep the width of beam within a certain value as well as the dispersion angle. Therefore, in the conventional construction of electrodes in which only one of electrode voltage 12*f* is adjustable, it is difficult to perform such an adjustment as to satisfy the limitations of, controlling both the angle of dispersion and the width of beam at the same a time.

SUMMARY OF THE INVENTION

The present invention provides a highly sensitive mass spectrometer which is capable of easily performing such an adjustment as to satisfy the limitation of controlling both the angle of dispersion and the width of the beam at the same time.

The present invention can be attained, in an ion source for mass spectrometer where generated ions are extracted from a slit of an acceleration electrode to make an ion beam and said ion beam is focussed with a focussing electrode to be extracted from a projecting slit, by providing an extractor electrode, which separates the cross-over point of the ion beam apart from the acceleration electrode by a desired distance, in the vicinity of the down-stream of said acceleration electrode.

The present invention can also be attained by providing an extractor electrode having a width of slit smaller than the width of slit in the acceleration electrode in a position apart in the down-stream side of said acceleration electrode by a distance nearly equal to the distance between the acceleration electrode and the ion generating region.

The present invention can also be attained by setting the voltage applied to the extractor electrode in accordance with the state of the ion source.

According to conventional construction, since the ion beam extracted from an acceleration electrode is crossed over just after being extracted, the dispersion angle becomes large. However, in the present invention, since the cross-over point can be spaced apart from the acceleration electrode by providing an extractor electrode, the dispersion angle can be suppressed and an ion beam excellent in focussing and good in quality can be attained. Since the voltage applied to the extractor electrode is adjustable, the limitations of both the angle of dispersion and the width of beam can be satisfied at a time.

BRIEF DESCRIPTION OF THE DRAWINGS

FIG. 5A is a view showing the result of computer simulation of a conventional ion source of electron bombardment ionization type.

DETAILED DESCRIPTION

An embodiment according to the present invention will be described in detail below, referring to the accompanying drawings.

Figure 2A:
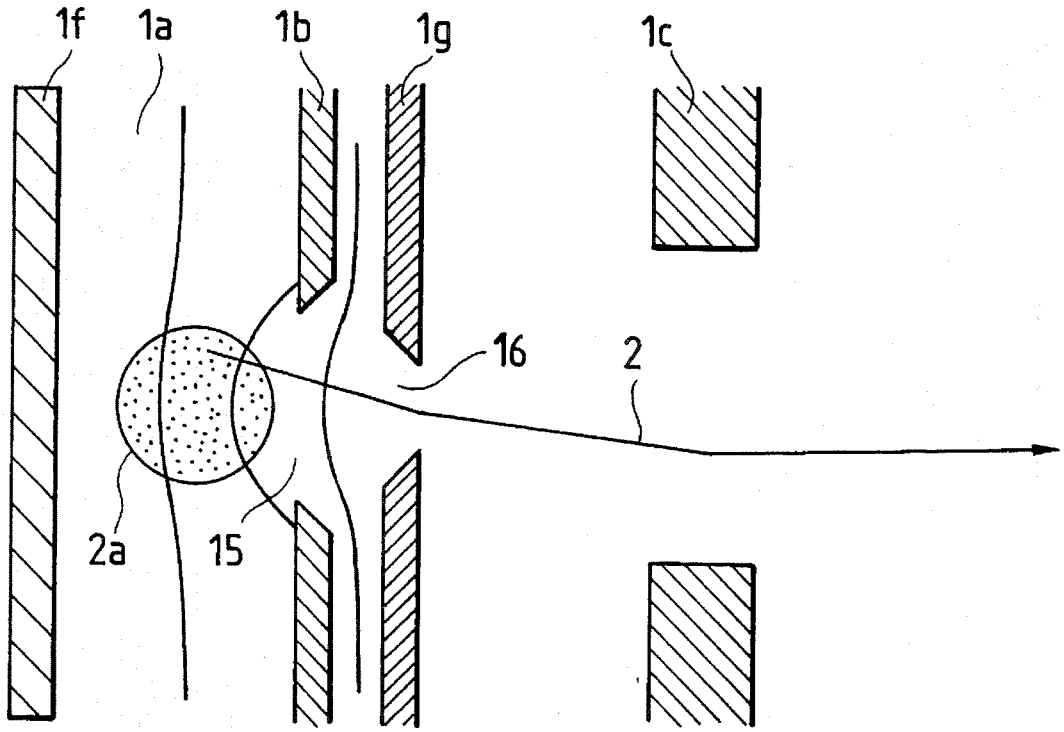
FIG. 2A is a view explaining the principle of decreasing an angle of dispersion using an embodiment of an ion source according to the present invention.
Figure 2B:
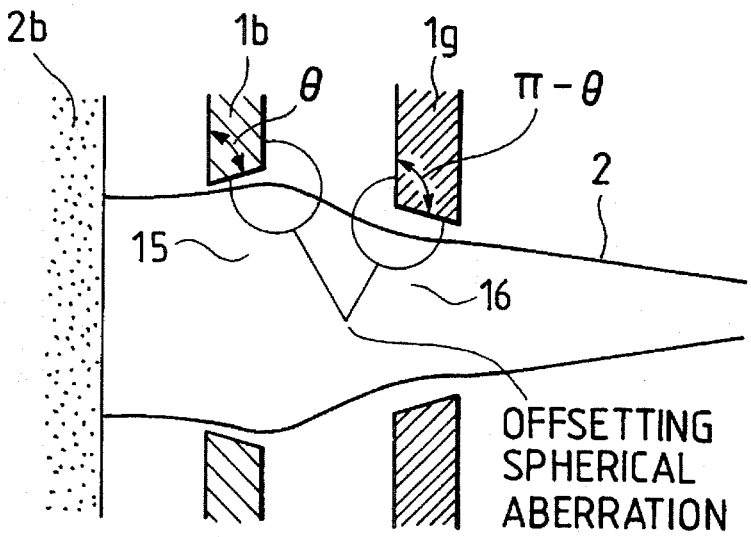
FIG. 2B is a view explaining the principle of decreasing an angle of dispersion using another embodiment of an ion source according to the present invention.

Initially, the principle of the present invention will be described. FIG. 2A is an explanatory view showing the construction of an electrode in an ion source of electron bombardment ionization type, and FIG. 2B is an explanatory view showing the construction of an electrode in a plasma ion source. In both of the FIGS. 2A and 2B, movement of ion beams are schematically illustrated. In the present invention, an extractor electrode 1*g* as an auxiliary electrode is provided in a position outside and apart from an acceleration electrode 1*b* by the distance nearly equal to the width of a slit 15, and the applied voltage to the extractor electrode 1*g* is determined based on the state of the ion source.

The ions generated in an ion generating region 2*a*, that is located nearly the center of an ionization chamber 1*a*, are repelled with a repeller electrode 1*f* to which a positive voltage several volts higher than the voltage of the acceleration electrode 1*b* is applied, and pushed out toward the side of the acceleration electrode 1*b*. However, the initial speed of the generated ions is disturbed due to thermal motion and collision with electrons. Therefore the ions cannot effectively pass through the slit 15 of the acceleration electrode 1*b* only by the electric field formed by the repeller electrode 1*f*.

In this embodiment, the width of the slit 15 of the acceleration electrode 1*b* is made larger than the width of the slit 16 of the extractor electrode 1*g*, and the extractor electrode 1*g* is set in a position apart from the acceleration electrode 1*b* by a distance nearly equal to the distance between the acceleration electrode 1*b* and the ion generating region 2*a*.

By doing so, the electric field leaked from the slit 15 of the acceleration electrode 1*b* to the inside of the ionization chamber 1*a* penetrates to the vicinity of the ion generating region 2*a*. As the result, the position of the cross-over point 2*c*, of an ion beam 2 comes to the down-stream of the extractor electrode 1*g*, and consequently the ion beam 2 is effectively extracted through the slit 15 by the leaking electric field (penetrating electric field) to pass through the slit 15 of the extractor electrode 1*g*. Such penetrating electric field sharply falls off as the distance from the slit increases. Therefore, the increase in the electric field inside the ion generating region 2*a* is very small and the increase in the energy dispersion of the ion beam 2 is negligible.

On the other hand, in a case of plasma ion source (FIG. 2B), a sheath region having a length of approximately several times of Debye length is formed between the acceleration electrode 1*b* and the plasma 2*b*. The plasma 2*b* comes to have an electric potential several volts serveral tens of volts higher than the acceleration electrode 1*b* to effectively accelerate the ion beam toward the side of the acceleration electrode 1*b*. The voltage in this state is called a plasma floating electric potential, and is approximately six times as high as the so-called electron temperature which is one of the most important parameters of plasma.

Since ions are emitted from the entire surface of the plasma, the amount of ion current becomes a value approximately proportional to the width of the slit 15 of the acceleration electrode 1*b*. However, the spherical aberration in the edge portion of the slit 15 is larger than that near the central portion, and the ions passed through near the edge portion of the slit 15 are excessively focussed, which increases the angular dispersion. In order to offset the excessive focussing, the width of the slit 16 of the extractor electrode 1*g* is narrowed as to have a geometrical similarity with the width of the ion beam 2. That is, the cut angle of the slit 16 is formed in $\pi$-$\theta$ against the cut angle $\theta$ of the slit 15 to decrease the over-all spherical aberration by offsetting the spherical aberration of the slit 15 with the spherical aberration of the slit 16. Therewith, an ion beam 2 having a small angular dispersion can be obtained.

Figure 4:
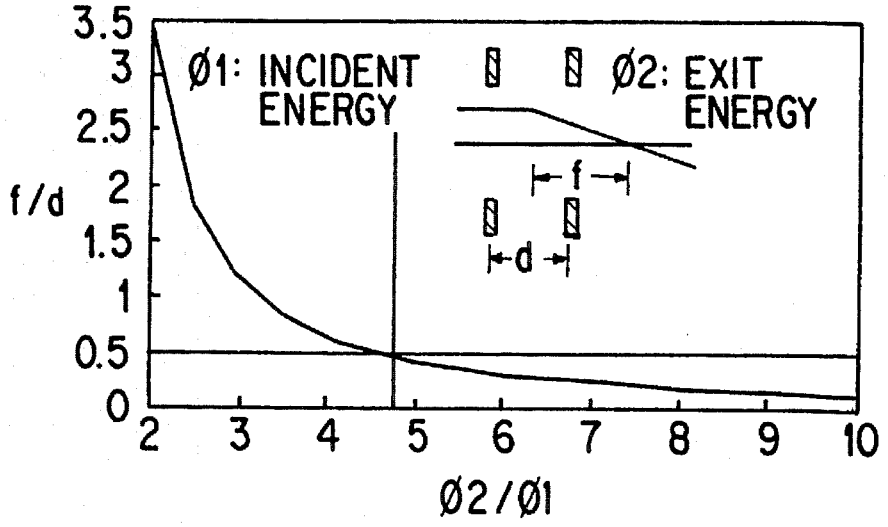
FIG. 4 is a graph showing the relationship between the voltage of extractor electrode and the focal length.

FIG.4 is a graph showing the relationship between the ratio f/d of a focal length f to a distance d between the two electrodes and the ratio $\Phi 2/\Phi 1$ of an exit energy $\Phi 2$ to an incident energy $\Phi 1$. When this relationship is applied to the case of FIG. 2A, $\Phi 1$ corresponds to one-half of the electric potential difference between the repeller electrode if and the acceleration electrode 1*b* , and $\Phi 2$–$\Phi 1$ corresponds to the electric potential difference between the acceleration electrode 1*b* and the extractor electrode 1*g*. A short focal length f is undesirable because the angular dispersion of beam increases. In order to decrease the angular dispersion, it is necessary to lengthen the focal length f to form the cross-over point where the beam converges the narrowest in the down-stream side of the extractor electrode 1*g*. Describing quantitatively, it can be understood that the voltage applied to the extractor electrode 1*g* may be set so as to satisfy $\Phi 2/\Phi<5$.

Figure 3:
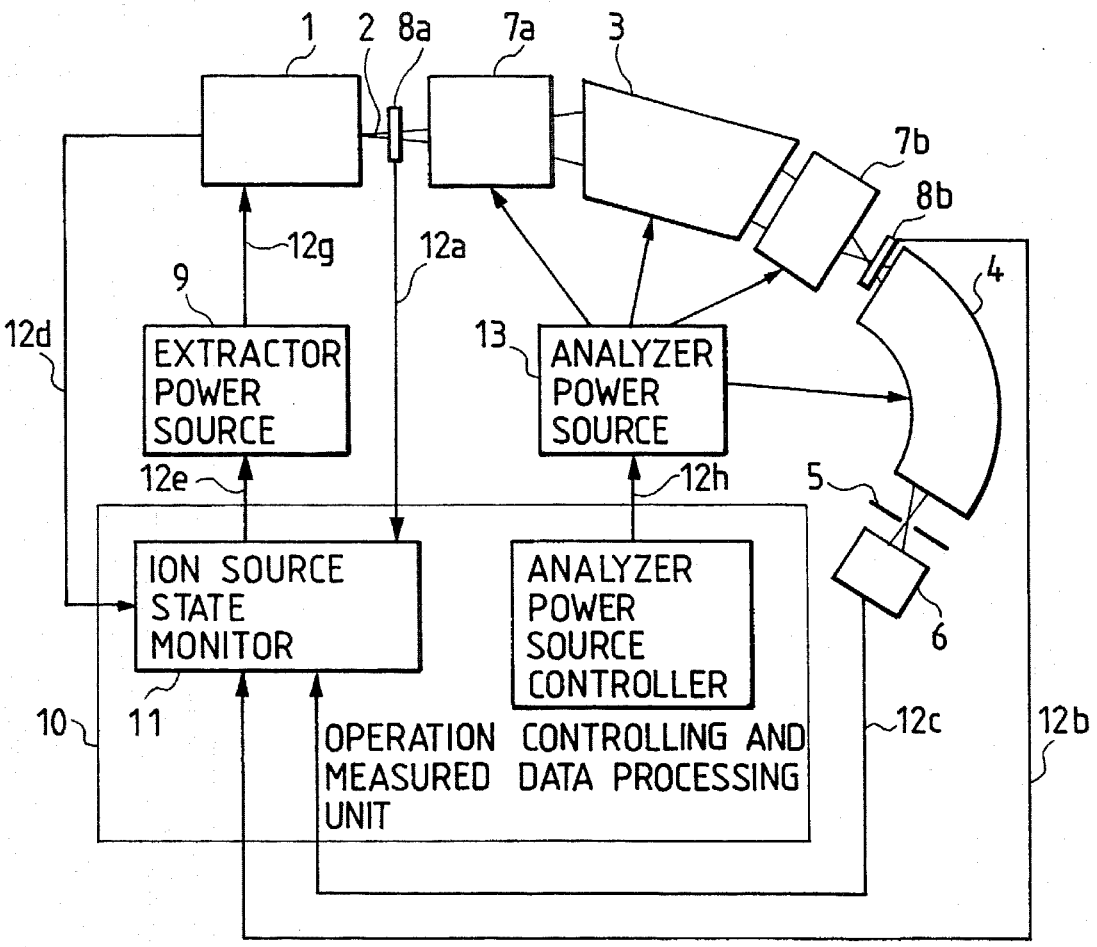
FIG. 3 is a view showing the over-all construction of an embodiment of a mass spectrometer according to the present invention.

An embodiment according to the present invention will be described below, referring to the entire construction of FIG. 3 and the cross-sectional view of the ion source and the beam extractor electrode system of FIG. 1.

This embodiment is a mass spectrometer of double convergence type to which the present invention is applied. The ions generated in an ion source 1 are extracted as a form of ion beam 2 having good focussing, being dispersed with a quadru-pole lens 7*a*, mass separation being performed with a sector magnetic field 3, then energy discrimination being performed with a sector electric field 4 after being converged with a quadru-pole lens 7*b*, finally the ion current is passed through a mass separation slit 5 and measured with a detector 6. The measure result is stored in a processing unit 10 for operation control and measured data as a mass spectrum. In a case of, for example, an ion source of electron bombardment type, the voltage 12*d* of a repeller electrode is input to an ion source state monitor 11 and the voltage 12*e* of an extractor electrode is output to an extractor power source 9. In a case of a plasma ion source, it is difficult to measure the plasma floating electric potential directly. However, it is possible to estimate the plasma floating electric potential since the relation between the track radius R and the sum $V_{acc}+V_p$ of the actual acceleration voltage of the acceleration electrode voltage $V_{acc}$ and the plasma floating electric potential $V_p$ can be expressed by the following equation.

$$R=2(V_{acc}+V_p)/E$$

where E is the strength of electric field of the sector electric field 4.

Although the voltage of the extractor electrode 1*g* obtained in such a manner is a good predicted value, it is not always an optimum value. Therefore, an ion source state monitor 11 receives a measured value 12*a* of an ion current monitor 8*a* provided on the beam line, and adjusts the voltage of the extractor electrode system so that the current value becomes the maximum.

Figure 8:
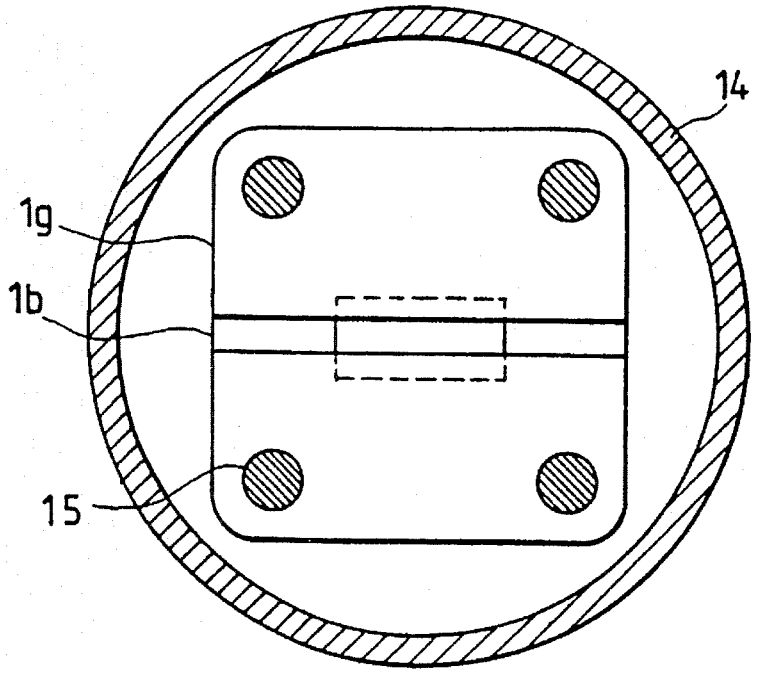
FIG. 8 is a cross-sectional view taken on the plane of the line A—A' of FIG. 1.

FIG. 9. shows the detailed construction of an ion source and one of the simplest methods of setting the voltage of an extractor electrode. The entire ion source is attached to a vacuum chamber 16 in a beam line of an analyzing part with electrode support insulators 15. The entire ion source is held in a vacuum environment with a vacuum chamber 14. The extractor electrode 1*g* is composed of two plate electrodes, top and bottom electrodes, as shown in the A—A' cross-sectional view of FIG. 8. The acceleration electrode 1*b* is a plate electrode having a rectangular opening. The ion source state monitor 11 sets the voltage 12*g* of the extractor electrode 1*g* based on the voltage 12*d* of the repeller electrode 1*f*. The current passing through the slit is measured with an ion current monitor 8*a*, and the ion source state monitor adjusts the voltage 12*f* of a converging electrode 1*c* so that the current becomes to the maximum value.

Figure 1:
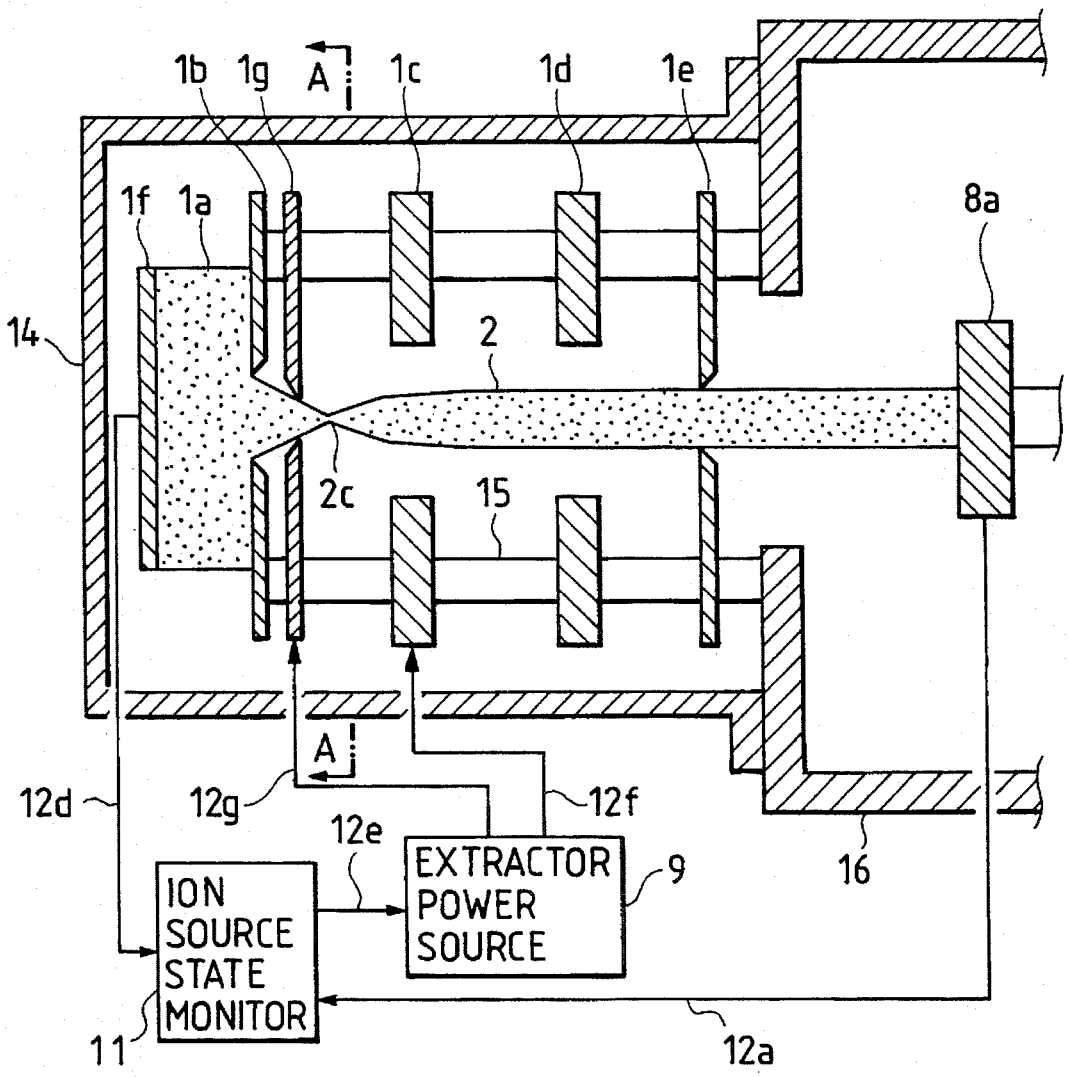
FIG. 1 is a structural view showing an embodiment of an ion source according to the present invention.

In the embodiment in FIG. 1, a power source 9 is used as a power source for the focussing electrode 1*c* as well as a power source for the extractor electrode In this case, although the applied voltages to the electrodes 1*c* c and 1*g* are the same, it is not problem. Thereby, the number of the power sources can be decreased. However, it is needless to say that individual power sources for separate electrode may be provided.

FIG. 5 and FIG. 6 are views showing results of computer simulation to confirm the effects of the embodiment in FIG. 1.

FIG. 5A shows a result of computer simulation of a conventional ion source of electron bombardment ionization type. The voltage $V_{acc}$ of acceleration electrode is 6.000 kV, the voltage $V_r$ is 6.003 kV, the width of slit in the acceleration electrode is 0.5 mm. The ions have an isotropic initial speed equivalent to 0.01 eV, and some of the ions cannot pass through the slit of the acceleration electrode since the width of the ion beam is expanded as the ion beam approaches to the acceleration electrode. Further, the ion beam comes to have a large angular dispersion since the ion beam is sharply converged inside the slit. The beam width is expanded more than 1 mm in the vicinity of the focussing electrode, which makes the focussing of the beam in the down-stream difficult. Under such a condition, an increase in the width of slit in the acceleration electrode is not effective for increasing the current of the ion beam. It only increases ineffective current.

Figure 5B:
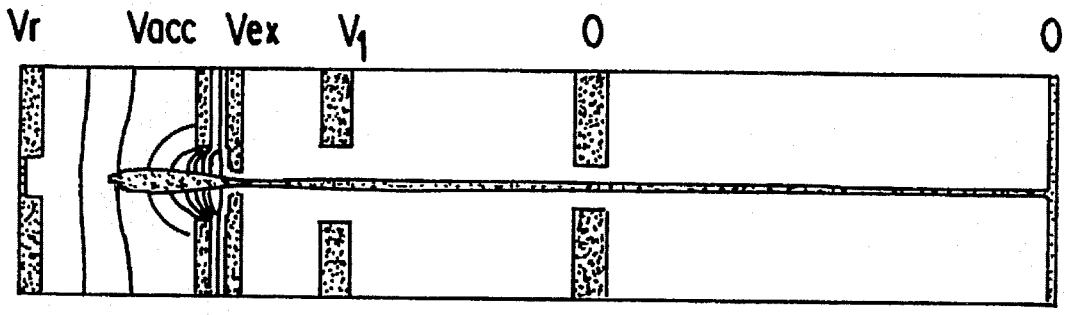
FIG. 5B is a view showing the result of computer simulation of an ion source of electron bombardment ionization type according to the present invention.

On the other hand, in the embodiment shown in FIG. 5B, the width of slit in the acceleration electrode is 1 mm, the width of slit in the extractor electrode is 0.5 mm, and $V_{ex}$=5990 V is applied to the extractor electrode. The electric field penetrates from the wide-width slit of the acceleration electrode into the vicinity of the ion generating region, and the all ions emitted isotropically can be extracted. The focal length of the extractor electrode 1*g* is changed by adjusting Vex by only several volts, which is easy to control the angular dispersion of the ion beam. With the reasons described above, it is confirmed that the current is increased to approximately two times as large as that in the conventional ion source, and the angular dispersion is decreased to approximately one-half as small as that in the conventional ion source. Further, since the width of the slit 16 of the extractor electrode 1*g* is narrow, there is an additional effect in that the gas pressure inside the ionization chamber la can be kept high and at the same time the degree of vacuum on the beam line can be kept high.

Figure 6A:
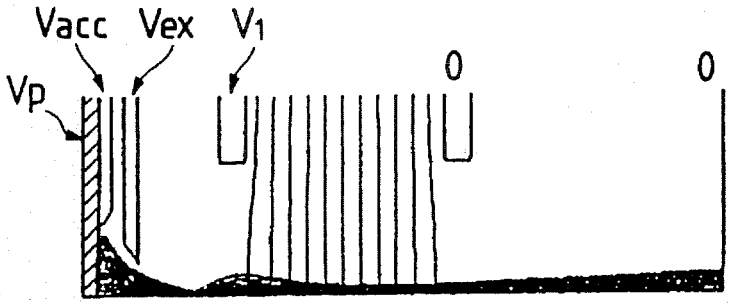
FIG. 6A, FIG. 6B and FIG. C are views showing the results of computer simulation of a plasma ion source according to the present invention.
Figure 6B:
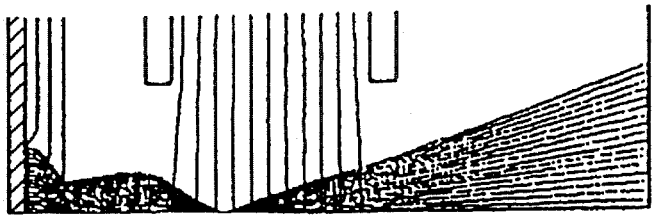
Figure 6C:
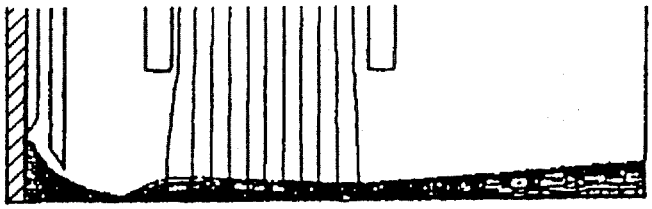
Figure 7:
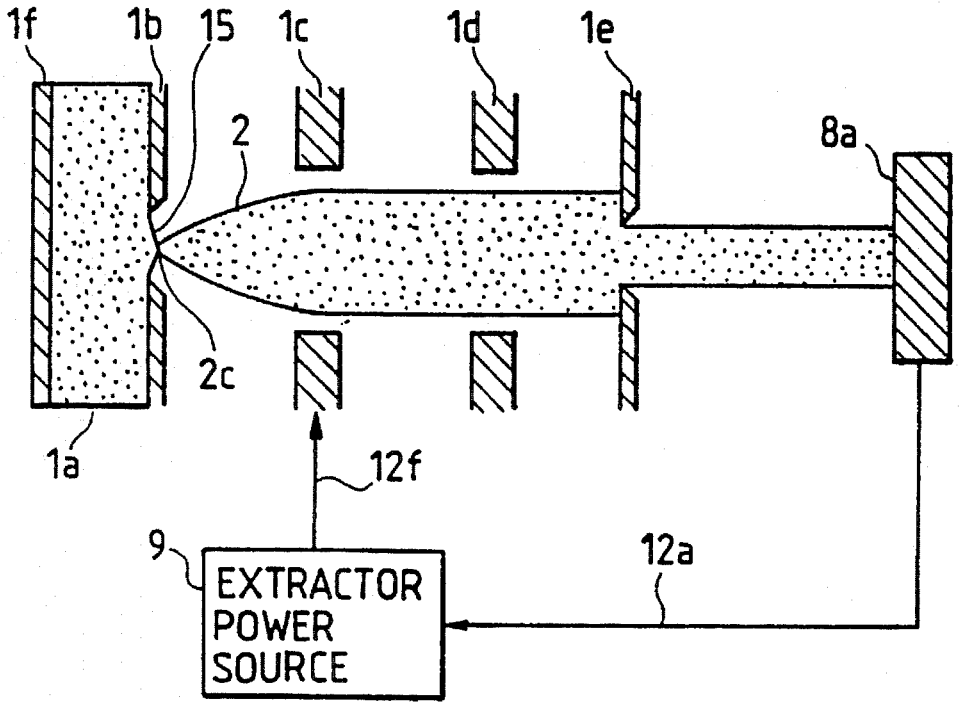
FIG. 7 PRIOR ART
FIG. 7 is a view showing the construction of a conventional ion source.

FIGS. 6A to 6C show simulation results of the plasma ion source. FIG. 6A is in a case of the plasma floating potential $V_p$ of 30 V. In FIGS. 6A to 6C, the voltage $V_{acc}$ of the acceleration electrode is maintained at 6.00 kV and the plasma floating potential $V_p$ means the relative voltage to Vats. It is confirmed that the optimum voltage $V_{ex}$ of the extractor electrode in this case is 5.88 kV. In this case, the difference of voltage between $V_{acc}$ and $V_{ex}$ is 120 V. Next, when the plasma floating potential $V_P$ is increased to 60 V with fixing the extractor electrode voltage $V_{ex}$, the ion beam is not converged as shown in FIG. 6B. Then, it is confirmed that an ion beam in a nearly optimum converged state can be obtained by adjusting the extractor electrode voltage $V_{ex}$ to 5.760 kV in proportion to an increase in the plasma floating voltage, as shown in FIG. 6C. In this case, the difference of voltage between $V_{acc}$ and $V_{ex}$ is varied from 120 V to 240 V according to the change of $V_P$ from 30 V to 60 V.

What is claimed is:

1. An ion source in which generated ions are extracted from a slit of an acceleration electrode to form an ion beam, said ion beam being focussed with a focussing electrode to be extracted from an extracting slit, wherein:

an extracted electrode is provided in between said acceleration electrode and said focussing electrode in vicinity of said acceleration electrode to locate a cross-over point of said ion beam at a position distanced from the acceleration electrode by a desired distance.

2. An ion source according to claim 1, which is so constructed that spherical aberration affecting said ion beam at the slit of said acceleration electrode is substantially canceled out by that at the slit of said extractor electrode.

3. An ion source according to claim 2, which is so constructed that the spherical aberration is offset by forming the cut angle of the slit of the extractor electrode $\pi$-$\theta$ against the cut angle $\theta$ of the slit of the acceleration electrode.

4. A mass spectrometer in which ions generated in an ion source are extracted with an extractor electrode system to form an ion beam, the amount of ion current of a specified mass being measured by separating the ion beam into tracks inherent in the mass of ion in the electric and magnetic fields, which comprises the ion source according to claim 1, as an ion source.

5. A mass spectrometer according to claim 4, wherein:

the voltage applied to the extracting electrode is determined by the condition of voltage in the ion source.

6. A mass spectrometer according to claim 5, wherein said ion source is an ion source of electron bombardment type and the voltage applied to the extractor electrode is set based on the voltage of a repeller electrode for repelling the generated ions toward the side of the extractor electrode.

7. A mass spectrometer according to claim 5, wherein the voltage applied to the extractor electrode is adjusted based on the measured value of an ion current monitor installed on the ion beam line to minimize the measured value.

8. A mass spectrometer according to claim 5, wherein said ion source is a plasma ion source and the voltage applied to the extractor electrode is set based on the plasma floating potential.

9. A mass spectrometer according to claim 8, wherein said plasma floating potential is measured using the radius of gyration of ion in the electric and magnetic fields.

10. An ion source in which ions generated in an ion generating region are extracted from a slit of an acceleration electrode to form an ion beam, said ion beam focussed with a focussing electrode to be extracted from an extracting slit, wherein:

an extractor electrode having a narrower slit than the slit of the acceleration electrode is provided between said acceleration electrode and said focussing electrode in the vicinity of said acceleration electrode at a distance from the acceleration electrode by approximately the same distance as a distance between the acceleration electrode and the ion generating region.

11. A mass spectrometer of double convergence type having an ion source, a first quadru-pole lens to disperse an ion beam extracted from said ion source, a sector magnet to mass-separate the ion beam dispersed with said first quadru-pole lens, a second quadru-pole lens to converge the ion bean mass-separated with said sector magnet, a sector electric field unit to energy-discriminate the ion beam focussed with said second quadru-pole lens, a mass separation slit placed in the rear stage of said sector magnet, a detector to measure the ion current passed through said mass separation slit, wherein the ion source in which generated ions are extracted from a slit of an acceleration electrode to form an ion beam, said ion beam being focussed with a focussing electrode to be extracted from an extracting slit, wherein:

an extractor electrode is provided in between said acceleration electrode and said focussing electrode in the vicinity of said acceleration electrode to located a cross-over point of said ion beam at a position from the acceleration electrode by a desired distance.

* * * * *

UNITED STATES PATENT AND TRADEMARK OFFICE

CERTIFICATE OF CORRECTION

PATENT NO. : 5,532,483

DATED : 2 July 1996

INVENTOR(S) : Yoichi OSE et al.

It is certified that error appears in the above-identified patent and that said Letters Patent is hereby corrected as shown below:

Title page, item [57] col. 2,

IN THE ABSTRACT: Line 2: Change "limitations" to --limitation--.

Line 20: After "extractor" insert --electrode--.

| Column | Line | |
|---|---|---|
| 1 | 16 | Change "if" to --1*f*--. |
| 1 | 18 | After "1*a*" insert --is applied--; delete "applied and". |
| 1 | 23 | After "1*b*" delete ".". |
| 1 | 49 | After "same" delete "a". |
| 3 | 40 | After "volts" insert --to--. |
| 4 | 4 | Change "if" to --1*f*--. |
| 4 | 15 | Change "Φ2/Φ<5" to --Φ2/Φ1<5--. |
| 5 | 12 | After "electrode" insert --1*g*--. |
| 5 | 13 | After "1*c*" delete "*c*". |
| 5 | 49 | Change "Vex" to --$V_{ex}$--. |

UNITED STATES PATENT AND TRADEMARK OFFICE

CERTIFICATE OF CORRECTION

PATENT NO. : 5,532,483

DATED : 2 July 1996

INVENTOR(S) : Yoichi OSE et al.

It is certified that error appears in the above-identified patent and that said Letters Patent is hereby corrected as shown below:

| Column | Line | |
|---|---|---|
| 5 | 67 | Change "Vats." to --$V_{acc}$--. |
| 6 | 18 | Change "extracted" to --extractor--. |
| 6 | 19 | Before "vicin-" insert --the--. |
| 6 | 62 | Before "focussed" insert --being--. |
| 8 | 11 | Change "located" to --locate--. |

Signed and Sealed this

Twenty-second Day of October, 1996

*Attest:*

BRUCE LEHMAN

*Attesting Officer*

*Commissioner of Patents and Trademarks*